United States Patent [19]

Daily

[11] Patent Number: 4,923,233

[45] Date of Patent: May 8, 1990

[54] LATCH ASSEMBLY

[76] Inventor: Raymond P. Daily, 2270 Camino Vida Roble, Ste. I, Carlsbad, Calif. 92001

[21] Appl. No.: 246,810

[22] Filed: Sep. 20, 1988

[51] Int. Cl.[5] ..... E05C 5/02

[52] U.S. Cl. ..... 292/332; 292/68

[58] Field of Search ..... 292/63, 67, 68, 153, 292/156, 162, 216, 332, DIG. 72

[56] References Cited

U.S. PATENT DOCUMENTS

| | | | |
|---|---|---|---|
| 1,091,592 | 3/1914 | Schmidgall | 292/332 X |
| 1,240,086 | 9/1917 | Parker | 292/332 |
| 2,546,333 | 3/1951 | Curtiss, Jr. | 292/332 |
| 2,679,428 | 5/1954 | Rop | 292/332 |
| 2,865,668 | 12/1958 | Krause | 292/216 |
| 3,312,490 | 4/1967 | MacDonald | 292/153 |

*Primary Examiner*—Richard E. Moore

*Attorney, Agent, or Firm*—Brown, Martin, Haller & McClain

[57] ABSTRACT

A door latch assembly for holding a door in a closed position comprises a latch housing for mounting in the side of a door frame, and a latch pin for mounting on the corresponding side of a door to project towards the latch housing. The latch housing has an opening for receiving the latch pin as the door is closed, and a latch member in the housing is movable between a first, latching position in which the latch pin is held in the housing and a second, release position in which the latch pin is released and pushed out of the housing in a door opening direction. An actuator projects out of the housing for moving the latch member into the second position. The latch member is biased towards its latching position.

14 Claims, 1 Drawing Sheet

LATCH ASSEMBLY

BACKGROUND OF THE INVENTION

The present invention relates generally to a door latch assembly, and is concerned with a latch assembly particularly suitable for latching the doors of bird or other animal cages and the like.

Standard door latches consist of a spring loaded latch bolt on a door which engages in a corresponding opening on the door frame when the door is closed to hold the door in its closed position. Rotation of the door knob releases the bolt from the opening, allowing the door to be pulled or pushed open.

One disadvantage where this type of latch is used on cages for holding birds or other animals is that two separate actions are required to open the door, one to release the latch and the other to open the door on latch release, which may be difficult where food is being carried or where a bird or animal is simultaneously being held prior to return to the cage. Another problem in designing latches for bird or other animal cages is that they must be relatively inaccessible or tamper proof from the interior.

SUMMARY OF THE INVENTION

It is an object of this invention to provide an improved door latch assembly.

According to the present invention, a door latch assembly for holding a door in a closed position is provided, which comprises a latch housing for mounting on one side of a door frame surrounding a door opening, and a latch pin for mounting on the corresponding side of a door mounted in the door frame. The latch housing has an opening for receiving the latch pin when the door is closed, a latch member is mounted in the housing, and a finger operated actuating member projects from the housing for moving the latch member between a first, latching position in which the latch pin is held in the housing and a second position in which the latch pin is released and urged out of the housing. A biasing device is preferably provided to urge the latch pin out of the housing in a door opening direction as the latch member moves to its second position.

This allows an essentially hands-free door opening operation, since the door opens automatically on operation of the actuating member, without having to hold the latch member in its second position while the door is opened. The latch pin is automatically urged out of the housing as the latch is released, leaving the operator's hands free to hold articles, or to reach for a creature in the cage to prevent escape, for example.

In the preferred embodiment of the invention, the latch member is biased towards its locking position in the housing, and a stop is provided for holding the latch member in its second position against the biasing action. Entry of the latch pin into the housing on closing the door automatically releases the latch member from the stop, so that it moves into its locking position and holds the latch pin in the housing. Again, little or no manipulation by the person closing the door is required in order to activate the latch, but the latch is automatically locked when the door is closed, preventing escape by any occupant of a cage, for example.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
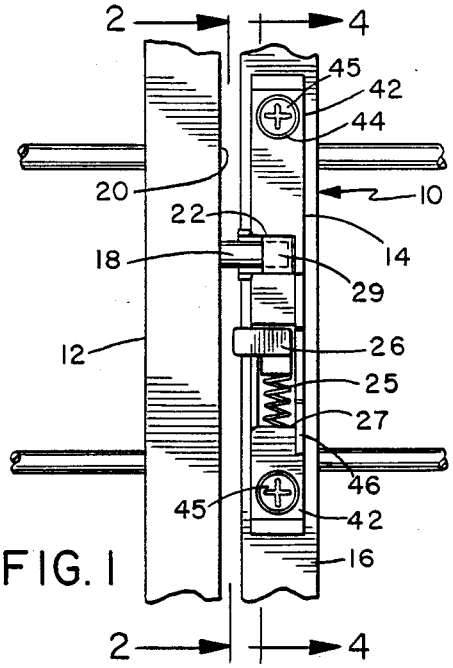
FIG. 1 is a front view of the latch assembly according to a preferred embodiment of the invention in its closed position.

The drawings illustrate a latch assembly, generally indicated by the reference numeral 10, for holding a door 12 in a closed position. Although the latch assembly is particularly suitable for use on animal cages or the like, it would also be useful for holding any door closed. The latch assembly 10 basically comprises a latch housing 14 for mounting on one side of a door frame 16 surrounding a door opening, and a latch pin 18 mounted to project outwardly from the corresponding side edge 20 of a door 12 mounted in the opening. FIG. 1 shows the door and door frame as comprising parts of a cage of metal grille construction. However, it will be understood that the latch assembly may be used between any door and door frame, for example on cupboards, in building doorways, on vehicles, and so on.

Figure 2:
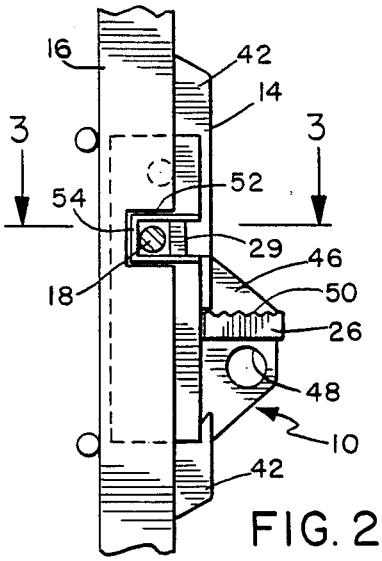
FIG. 2 is a sectional view taken on the line 2—2 of FIG. 1.
Figure 3:
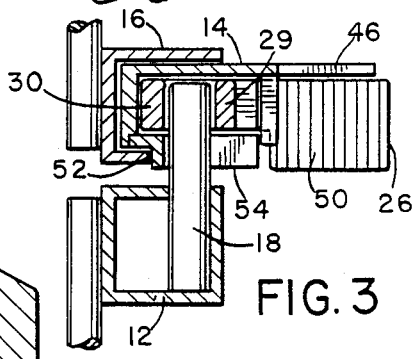
FIG. 3 is an enlarged sectional view taken on line 3'3 of FIG. 2.
Figure 4:
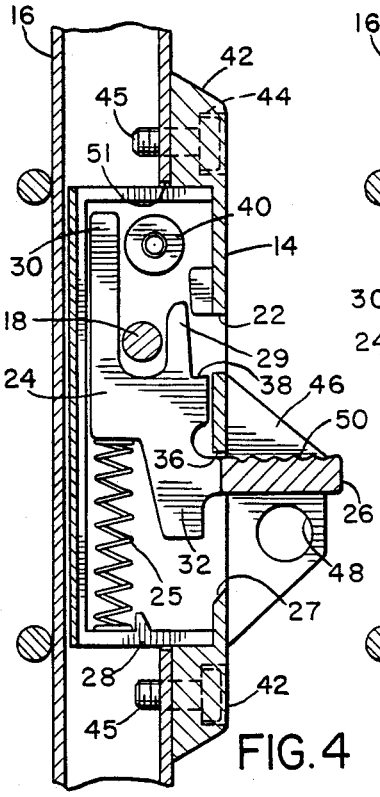
FIG. 4 is an enlarged sectional view taken on line 4—4 of FIG. 1.
Figure 5:
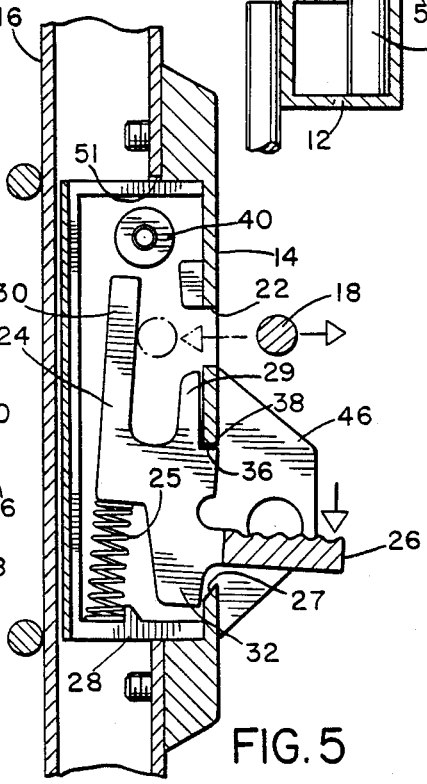
FIG. 5 is a view similar to FIG. 4, showing the opening and closing action of the latch.

The housing 14 has an opening 22 for receiving the latch pin 18 when the door is closed. Opening 22 extends across the front wall and part of the side wall of the housing, as illustrated in FIGS. 1 and 2, to allow the latch pin to project transversely into the housing. As best illustrated in FIGS. 3 to 5, a latch member 24 is mounted in the housing and is operated by means of actuator pad 26 which projects out of the housing through slot 27. Depression of pad 26 moves the latch member between the locking position shown in FIG. 4 in which the latch pin is held in the housing and the release position shown in FIG. 5 in which the latch pin is released and urged out of the housing in the door opening direction, as indicated by the solid arrow. The actuator pad 26 is designed for finger actuation and has an upper gripping surface 50 which ridged or grooved to resist slipping. A biasing spring 25 acts between a lower wall 28 of the housing and a centrally offset portion of the latch member to urge it into either the locking position of FIG. 4 or the release position shown in FIG. 5, as explained in more detail below.

The latch member and actuator in the preferred embodiment are of integral construction, comprising a body of metal or other suitable material having a pair of upwardly directed fingers or prongs 29, 30 between which the latch pin is held in the locking position, and a downwardly directed, tail portion 32 offset from the center of the body, from which the actuator pad or plate projects out of the housing via slot 27. The upper edge 36 of slot 27 acts as a stop engaging a corresponding recess or indent 38 in the front face of finger 29 when the latch member is in the release position illustrated in FIG. 5, as will be explained in more detail below. The fingers 29, 30 are of different lengths, with the shorter finger 29 extending across the opening 22 to hold the latch pin in place when in the locking position, and moving out of the opening to release the pin when the latch member is in the release position. A guide boss 40 is provided in the upper part of the housing for guiding finger 29 as the latch member is biased into its locking position.

The housing has upper and lower projecting mounting flanges 42 with openings 44 for insertion of suitable fasteners such as screws or the like for mounting the housing on a door frame with the opening facing in a door opening direction. Lock flange 46 projects transversely from the front face of the housing adjacent actuator 26, as indicated in FIGS. 2, 4 and 5, and has an opening 48 for receiving a suitable lock such as a padlock for locking the door in the closed position by preventing depression of the actuator.

Operation of the latching mechanism will now be described in more detail. As best illustrated in FIGS. 4 and 5, latch member 24 is free to move up and down in the housing, and is urged upwardly by spring 25. At the same time, since spring 25 is centrally offset, it will also tend to bias the member 24 to rotate in a clockwise direction. Such rotation is prevented until the actuator 26 is depressed, because of the engagement of the opposite sides of the latch member with the inner side walls of the housing (See FIG. 4). However, as soon as notch 38 is aligned with the upper edge 36 of slot 27, and finger 30 is below boss 40, the member is free to rotate into the position shown in FIG. 5 under the action of spring 25.

The longer finger 30 of the latch member acts as a bearing surface as the latch member moves in both the locking direction and the releasing direction. Consider first the release of the latch member to open the door. The latch assembly will initially be in the position shown in FIG. 4, with latch pin 18 retained between the fingers 29 and 30, finger 29 preventing movement of the pin out of opening 22 and spring 25 biasing the latch member upwardly to retain it in the locking or latching position. A padlock may be inserted through lock opening 48 at this point to prevent release of the latch member, securing the door in the closed position.

In order to open the door, any padlock or other locking mechanism present will first be removed from opening 48. At this point, a simple depression of pad 26 with the touch of a finger in the direction of the solid arrow in FIG. 5, will move latch member 24 down until finger 29 is below the lower edge of opening 22. At the same time, offset spring 25 will bias member 24 to pivot or rotate outwardly in a clockwise direction about its center, so that as soon as recess 38 is below the stop surface 36, the member will rotate or snap out to the right as viewed in FIG. 5, with finger 30 pushing latch pin 18 out of the housing in the direction of the solid arrow. Thus the door will pop open automatically with a simple finger depression of pad 26.

As the latch member releases the door and pushes it in a door opening direction, it will itself engage stop surface 36 so that it is held in the position illustrated in FIG. 5. When the door is again closed, the latch pin will therefore be free to enter the latch housing in the direction of the dotted arrow in FIG. 5, at which point it will engage finger 30, pushing the finger towards the rear wall of the housing. As soon as the latch member recess 38 moves out of alignment with stop 36, spring 25 will snap the latch member upwardly back into the locking position, at which point the latch pin will again be held between the latch fingers as indicated in FIG. 4.

Thus the latch assembly is easy to operate, involving a minimum of manipulation by the operator, leaving hands free for carrying objects such as feed dishes and the like in the case of animal or bird cages, or for carrying bags and packages in the case of house doors and the like. The door will pop open automatically with the touch of a finger, and will latch automatically simply by pushing the door closed.

The assembly is easy to install on any existing door and door frame. In the case of a cage structure of square tubing stock as illustrated in FIG. 1, the latch housing is mounted in a suitable rectangular opening 51 cut in the outer face of the side of the door frame remote from the hinge side, so that actuator pad 26 projects outwardly from the frame away from the cage. A slot 52 is cut in the inner side edge of the door frame for alignment with the side part of latch opening 22, as best illustrated in FIG. 2. The latch housing may be provided with a rim 54 surrounding the side part of the latch opening for easy location in slot 52. The mounting flanges 42 will bear against the outer face of the door frame above and below opening 51, and the housing can be secured to the frame via suitable screw fasteners 45 extending through aligned openings in the flanges 42 and door frame, as illustrated in FIGS. 4 and 5. The latch pin is suitably mounted to project outwardly from the outer side edge of the door at a location aligned with the latch opening 22.

Although a preferred embodiment of the invention has been described above by way of example only, it will be understood by those skilled in the field that modifications may be made to the disclosed embodiment without departing from the scope of the invention, which is defined by the appended claims.

I claim:

1. A latch assembly for holding a door in a closed position in a door frame, the assembly comprising:

a latch housing for mounting on one side of a door frame surrounding a door opening;

a latch pin for mounting on the corresponding side of a door mounted in the door frame so that it projects away from the door;

the housing having an opening for receiving said latch pin when the door is closed;

a latch member slidably mounted in the housing for sliding movement between a first, latching position in which said latch pin is held in said housing and a second, door release position in which said latch pin is released;

actuating means projecting from said housing and linked to said latch member for moving said latch member between said latching position and said door release position;

biassing means for urging said latch member into said latching position; and said latch member having a bearing surface facing said opening as said latch member slides between said latching and released position, said bearing surface comprising means for cooperating with said latch pin as said latch member moves towards said release position to urge said latch pin out of said housing in a door opening direction.

2. The assembly as claimed in claim 1, wherein said biassing means includes means for urging said bearing surface towards said opening as said latch member moves towards said release position to push said latch pin out of said housing when said latch pin is released.

3. The assembly as claimed in claim 1, wherein said latch member includes a first part for projecting across said opening to hold said latch pin in said housing in said first position, and a second part comprising said bearing surface for urging said latch pin out of said housing as said latch member moves into said second position.

4. The assembly as claimed in claim 3, wherein said latch member comprises a central body portion, said first and second parts comprising spaced first and second fingers projecting away from said central body portion in said first direction, said first finger being shorter than said second finger, and said latch pin being located between said fingers in said latching position.

5. The assembly as claimed in claim 4, wherein said biasing means includes means acting on said latch member for urging said second finger towards said latch opening when said first finger moves away from said opening.

6. The assembly as claimed in claim 5, wherein said biasing means comprises a single spring acting between an end wall of the housing and a centrally offset portion of said latch member for urging said second finger to rotate in a direction towards said opening, said housing having internal guide surfaces for engaging said latch member to prevent rotation except when said latch member is in said release position, said latch member and housing having cooperating cut-outs for allowing rotation of said finger as said latch member is moved into said release position.

7. The assembly as claimed in claim 1, including stop means for retaining said latch member in said second position, and release means for releasing said latch member from said stop means as said latch pin is urged into said housing.

8. The assembly as claimed in claim 7, wherein said release means comprises a portion of said latch member facing said opening in said second, door release position for engagement by said latch pin in a door closing direction to urge said latch member away from said stop means.

9. A latch assembly for holding a door in a closed position in a door frame, the assembly comprising:

a latch housing for mounting on one side of a door frame surrounding a door opening;

a latch pin for mounting on the corresponding side of a door mounted in the door frame so that it projects away from the door;

the housing having an opening for receiving said latch pin when the door is closed;

a latch member mounted in the housing for movement between a first, latching position in which said latch pin is held in said housing and a second, door release position in which said latch pin is released;

actuating means projecting from said housing and linked to said latch member for moving said latch member between said latching position and said door release position;

biassing means for urging said latch member into said latching position; and said housing having a lock plate projecting from said housing in the direction of said actuator means, said lock plate having an opening adjacent the path of movement of said actuator means for receiving a locking member to project across the path of said actuator means to lock the latch pin in the housing.

10. A latch assembly for holding a door in a closed position in a door frame, the assembly comprising:

a latch housing for mounting on one side of a door frame surrounding a door opening;

a latch pin for mounting on the corresponding side of a door mounted in the door frame so that it projects away from the door;

the housing having an opening for receiving said latch pin when the door is closed;

a latch member mounted in the housing for movement between a first, latching position in which said latch pin is held in said housing and a second, door release position in which said latch pin is released;

actuating means projecting from said housing and linked to said latch member for moving said latch member between said latching position and said door release position;

biassing means for urging said latch member into said latching position;

said latch member having bearing means facing said opening and said latch pin in said latching position for contacting said latch pin to urge it out of said housing as said latch member moves towards said release position; and said housing having a front wall and spaced side walls, said latch opening extending across at least part of said front wall and one side wall for facing a side edge of a door on which said latch pin is mounted for allowing said latch pin to travel transversely into said housing.

11. The assembly as claimed in claim 1, wherein the housing has an actuator slot, said actuator means comprising an actuator pad secured at one end to said latch member and projecting out of said housing through said slot for finger actuation to slide the latch member away from said opening and release said latch pin.

12. The assembly as claimed in claim 11, wherein said latch member comprises a central body, a pair of fingers projecting from the central body in the latching direction for engaging around a latch pin held in the housing, a first one of said fingers extending across said opening in said latching position and being positioned below said opening in said release position, and a tail portion projecting from said body in the opposite direction to said fingers, said actuator pad projecting transversely from said tail portion.

13. The assembly as claimed in claim 12, including stop means for retaining said latch member in said release position, said stop means comprising an upper end of said actuator slot, said latch member having a recess for engaging said stop means in said release position, the second finger comprising a bearing surface for facing said opening in said release position for engagement by said latch pin entering said opening in a door closing direction to urge said latch member away from said stop means to release said latch member for movement into said latching position under the action of said biasing means.

14. The assembly as claimed in claim 13, wherein said biasing means further comprises means for urging said second finger in a direction to push said latch pin out of said opening when said second finger is moved away from said opening.

* * * * *